US005274426A

United States Patent [19]

Goseki et al.

[11] Patent Number: 5,274,426

[45] Date of Patent: Dec. 28, 1993

[54] DEVELOPING APPARATUS AND DEVELOPER CARRYING MEMBER THEREFOR

[75] Inventors: Yasuhide Goseki; Akira Unno; Kenji Fujishima, all of Yokohama, Japan

[73] Assignee: Canon Kabushiki Kaisha, Tokyo, Japan

[21] Appl. No.: 32,156

[22] Filed: Mar. 12, 1993

Related U.S. Application Data

[63] Continuation of Ser. No. 888,491, May 27, 1992, abandoned.

[30] Foreign Application Priority Data

May 29, 1991 [JP] Japan ..... 3-153962

[51] Int. Cl.[5] ..... G03G 15/06

[52] U.S. Cl. ..... 355/259; 118/656; 118/658; 118/661; 355/245; 355/251; 355/253

[58] Field of Search ..... 492/16-18, 492/28; 355/259, 251, 253, 245; 118/657, 658, 661, 656, 653; 29/132

[56] References Cited

U.S. PATENT DOCUMENTS

| | | | |
|---|---|---|---|
| 4,368,971 | 1/1983 | Watanabe et al. | 355/253 |
| 4,656,964 | 4/1987 | Kanno et al. | 118/653 X |
| 4,674,439 | 6/1987 | Sakamoto et al. | 118/657 |
| 4,696,255 | 9/1987 | Yano et al. | 118/653 |
| 4,760,422 | 7/1988 | Seimiya et al. | 118/656 X |
| 4,982,692 | 1/1991 | Uematsu | 118/661 |
| 4,989,044 | 1/1991 | Nishimura et al. | 355/251 |
| 5,027,745 | 7/1991 | Yamazaki et al. | 118/658 |
| 5,072,690 | 12/1991 | Ishikawa et al. | 118/658 |
| 5,175,586 | 12/1992 | Goseki et al. | 355/259 |
| 5,202,729 | 4/1993 | Miyamoto et al. | 355/251 |

FOREIGN PATENT DOCUMENTS

| | | | |
|---|---|---|---|
| 0339944 | 11/1989 | European Pat. Off. . | |
| 0208769 | 12/1983 | Japan | 355/259 |
| 0087177 | 5/1986 | Japan | 355/259 |
| 0024570 | 2/1991 | Japan | 355/253 |
| 0098068 | 4/1991 | Japan | 355/253 |

OTHER PUBLICATIONS

H. B. Michaelson, Relation Between an Atomic Electronegatively Scale and the Work Function, IBM Journal of research and development, Jan. 1978, vol. 22, No. 1, pp. 72-80.

European Search Report.

*Patent Abstract of Japan*, vol 8, No. 171, Aug. 8, 1984, (P-293), Abstract No. 1608, Murasawa, Y, "Developing Device".

*Patent Abstracts of Japan*, vol. 6, No. 34, Mar. 2, 1982, p. 104, Abstract No. 912, Nakahata, K., "Developing Device".

*Primary Examiner*—A. T. Grimley

*Assistant Examiner*—Matthew S. Smith

*Attorney, Agent, or Firm*—Fitzpatrick, Cella, Harper & Scinto

[57] ABSTRACT

A developing apparatus for developing an electrostatic latent image includes a movable developer carrying member for carrying a one component developer to a developing zone in which the developer is supplied to an electrostatic latent image bearing member; a regulating member for regulating a thickness of a layer of the developer to be carried to the developing zone on the developer carrying member; wherein the developer carrying member includes a coating layer having a resin material in which fine graphite particles are disposed, and wherein this coating layer triboelectrically charges the developer, and the triboelectric charging capacity of this coating layer is larger in the middle region of the developer carrying member than in the end regions in its longitudinal direction.

41 Claims, 4 Drawing Sheets

DEVELOPING APPARATUS AND DEVELOPER CARRYING MEMBER THEREFOR

This application is a continuation of application Ser. No. 07/888,491 filed May 27, 1992 now abandoned.

FIELD OF THE INVENTION AND RELATED ART

The present invention relates to a developing apparatus for developing an electrostatic latent image formed on an image bearing member and a developer carrying member for carrying the developer to a developing zone, used with the developing apparatus.

In a developing apparatus for developing an electrostatic latent image formed on an image bearing member in the form of an electrophotographic photosensitive drum, for example, with magnetic toner particle of one component developer, friction between a developer carrying member in the form of a developing sleeve and magnetic toner particles is used to electrically charge the magnetic toner particles to a polarity opposite from that of the electrostatic image charge on the photosensitive drum and that of the reference potential of the development. The magnetic toner particles are applied on the developing sleeve as a thin layer and are conveyed to a developing zone where the developing sleeve is faced to the photosensitive drum. In the developing zone, the magnetic toner particles are transferred onto the electrostatic latent image on the photosensitve drum surface, and are deposited thereon, thus visualizing the electrostatic latent image into a toner image. Such a developing apparatus is known.

If, in such a developing apparatus, images having a large white background area are continuously developed, and thereafter, a different pattern is developed, the image formed may have hysteresis of the previous image. This is called "ghost development". The reason for the occurrence of the ghost image is as follows.

If the white background continues, the toner on the sleeve is not consumed, and therefore, a layer of very fine toner particles overcharged are electrostatically attracted on the surface of the sleeve with strong force. The fine particle toner layer is not easily transferred onto the photosensitive drum, and also prevents the triboelectric charging between the sleeve and fresh toner particles supplied thereto. Accordingly, if the images having large white background areas are continuously formed, and thereafter, a black image is formed, the image density of the black image is low. This is the reason why the ghost development occurs.

A developing apparatus, in which the occurrence of the ghost development is prevented, is proposed in U.S. Pat. No. 4,989,044, in which the sleeve is provided with an outer coating layer having fine graphite particles dispersed in a resin material. The fine graphite particles are effective to discharge the electric charge of the overcharged fine toner particles. In addition, it exhibits a high solid state lubricance, and therefore, is effective to weaken the attraction of the fine toner particles to the sleeve. This prevents production of the above-described fine toner particle layer, thus suppressing occurrence of the ghost development.

However, in such an apparatus, a problem other than the ghost development or phenomenon has arisen.

In other words, a slight difference occurred in image density between the central and end regions in the longitudinal direction of the sleeve. A measurement of the amount of the electric charge of the toner layer on the sleeve has revealed the difference in the amount of the toner charge between the end and central regions in the longitudinal direction of the sleeve.

The causes for this phenomenon can be estimated as being that the flowing speed of the toner becomes slower in the end regions of the sleeve than in the middle, because of the resistance from the side wall of the container, and as a result, the contact time between the toner and the sleeve in the end regions of the sleeve becomes longer than in the middle, thereby causing the triboelectric toner charge to be larger at the peripheries than in the middle.

Anyway, since the overcharged toner is attracted to the sleeve by the strong electrostatic mirror force, it becomes difficult to transfer it onto the photosensitive drum. Also, it becomes difficult for the fresh toner, which will be delivered onto such a toner layer as above, to obtain the necessary triboelectric charge for the development.

With the formation of the thus formed overcharged toner layer, the toner layer at the sleeve peripheries becomes excessively thick, which sometimes generates black spots at the peripheries of the developed image.

SUMMARY OF THE INVENTION

One of the objects of the present invention is to provide a development apparatus and a developer carrying member therefor, which can prevent the occurrence of the ghost phenomenon which is likely to occur in a low humidity environment where it is easy for the toner to be triboelectrically charged, and can form thereby a developed image with excellent quality not only in the middle of the picture but also at the peripheries.

Another object of the present invention is to provide a development apparatus and a developer carrying member therefor, which can form a developed image of excellent image quality whether in low humidity or high humidity.

According to an aspect of the present invention, there is provided a developing apparatus for developing an electrostatic latent image, including: a movable developer carrying member for carrying one component developer to a developing zone in which the developer is supplied to an electrostatic latent image bearing member; and a regulating member for regulating the thickness of the layer of the developer to be carried to the developing zone on the developer carrying member; wherein the developer carrying member includes a coating layer comprising a resin material in which fine graphite particles are dispersed.

This coating layer triboelectrically charges the developer, and its triboelectric charging capacity is larger in the middle region of the developer carrying member than in the end regions of the developer carrying member in the longitudinal direction.

The inclusion of the fine graphite articles in the coating layer of the developer carrying member permits escape of the electric charge of the overcharged fine toner particles. The solid state lubricance of the fine graphite particles mechanically eases the deposition force of the fine toner particles to the developer carrying member. In this manner, the occurrence of the ghost development or phenomenon is suppressed.

In addition, since the triboelectric charge capacity of the above-mentioned coating layer is larger in the middle regions than in the end region in the longitudinal direction of the developer carrying member, excessive triboelectric charge of the developer at the periphery can be prevented. Therefore, it is possible to form a developed image with uniform quality both at the peripheries and in the middle.

Other objectives and characteristics of the present invention will become evident from the following explanation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
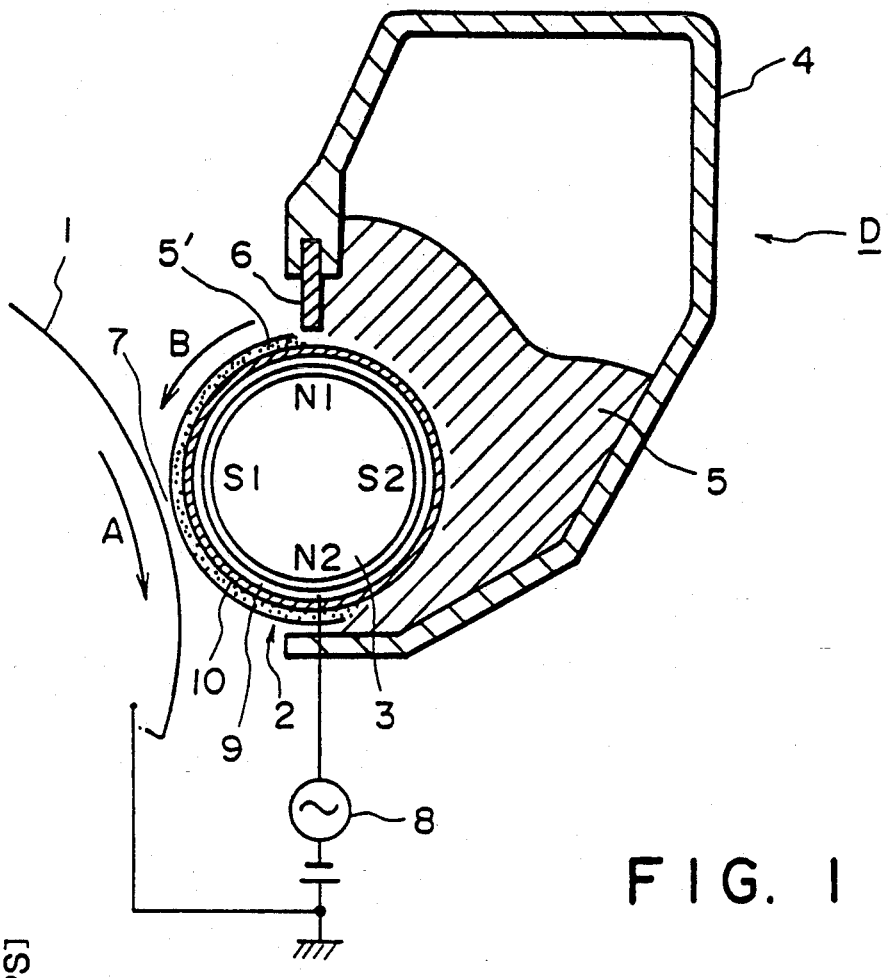
FIG. 1 is a sectional view of an embodiment of the present invention.

Referring to FIG. 1, there is shown a developing apparatus according to an embodiment of the present invention, which comprises an image bearing member in the form of an electrophotographic photosensitive drum 1 rotatable in a direction indicated by arrow A and is capable of bearing an electrostatic latent image. The photosensitive drum 1 may have a surface insulative layer. The photosensitive drum 1 may be replaced with a photosensitive sheet or belt.

The photosensitive drum 1 is uniformly charged to a negative polarity by an developing device (not shown), and is exposed to a laser beam modulated in accordance with an image information signal, so that a negative electrostatic latent image is formed. In place of the laser beam, the image information beam may be projected to the surface of the photosensitive drum 1 by an LED array or the like.

The electrostatic latent image is reverse-developed in a developing zone 7 by a developing apparatus D with a magnetic toner triboelectrically charged to a negative polarity.

The developing apparatus D comprises an image bearing member in the form of a developing sleeve 2 in an opening of a developer container 4 containing a one component developer, that is, magnetic toner 5. The developing sleeve 2 is faced to the photosensitive drum 1.

The developing sleeve 2 carries the toner 5 in the container 4 and rotates in a direction B. By doing so, the sleeve 2 carries the toner to the developing zone where the sleeve 2 is faced to the photosensitive drum 1. A plurality of magnetic poles of a permanent magnet 3 are stationarily disposed in the sleeve 2. At a position across the sleeve 2 from magnet N1 of the magnetic poles, a developer layer thickness regulating member in the form of the doctor blade 6 made of magnetic material is disposed with a predetermined gap from the developing sleeve 2 so as to regulate the toner layer on the developing sleeve 2 at a predetermined thickness. The magnetic field extending from a magnetic pole N1 is concentrated on the blade 6. In this embodiment, the gap between the doctor blade 6 and the developing sleeve 2 is approximately 50–500 microns.

In operation, when the developing sleeve 2 rotates in direction B, the toner 5 in developer container 4 is electrically charged to a polarity for developing the electrostatic latent image by friction with the surface of the developing sleeve 2, and is carried on the developing sleeve 2 surface. The layer of the toner 5 thus applied on the surface of developing sleeve 2 is regulated by the magnetic field between magnetic pole N1 of magnet 3 and the doctor blade 6 at a uniform and thin toner layer having a thickness of approximately 30–300 microns. With the developing sleeve 2 rotation, the toner 5 in the form of thin layer 5' is carried into the developing zone 7, where the toner is supplied to the surface of the photosensitive drum 1 to develop the electrostatic latent image thereon. More particularly, the toner is deposited on the light potential region of the latent image. The thickness of toner layer 5' is smaller than the minimum gap between the photosensitive drum 1 and the developing sleeve 2 in the developing zone 7 (50–500 microns, for example), and the developing action is what is called a non-contact type developing action.

The developing sleeve 2 is supplied with an oscillating bias voltage in the form of a DC biased AC voltage from the voltage source 8. By doing so, an oscillating electric field promotes removal of the toner from the sleeve 2 toward the drum 1, and therefore, a high density image without a foggy background can be produced.

In this embodiment, the developing sleeve 2 is provided with a surface coating layer 10 of a resin material containing at least crystalline graphite as conductive fine particles, the layer having a thickness of approximately 0.5–30 microns. A base member of the developing sleeve 2 on which the coating layer 10 is applied is in the form of a cylinder 9, made of aluminum, stainless steel, or the like.

As for the fine conductive particles, fine crystalline graphite particles or a mixture of fine amorphous carbon particles and crystalline graphite fine particles, are usable. The crystalline graphite usable in this embodiment may be classified as natural graphite or artificial graphite. The artificial graphite may be produced by solidifying pitch cokes with tar, sintering it at approximately 1200° C., and putting it in a graphitizing furnace to heat it at approximately 2300° C. to develop the carbon crystal into graphite. The natural graphite, of course, is produced by long term ground heat and pressure.

The carbon graphite is a dark gray or blacks, glossy and very soft crystal of carbon showing a high sliding property. The crystalline structure thereof is hexagonal or rhombohedral and is completely laminated. As for its electrical nature, there are free electrons in the combination between carbons, so that it is a good electrical conductive material. In this embodiment, either the natural or artificial graphite is usable. The preferable average particle size of the graphite is 0.5–20 microns.

As for the fine carbon particles, conductive amorphous carbon is usable. The conductive amorphous carbon is generally defined as an aggregate of crystals produced by burning or pyrolytically decomposing a compound including hydrocarbon or carbon under poor supply of air. The average particle size of the electrically conductive amorphous carbon used in this embodiment is preferably 10–80 mμ, and further preferably 15–40 mμ.

The usable binder resins in which the fine conductive particles are disposed include, for example, thermoplastic resins such as styrene resins, vinyl resins, polyether sulfone resins, polycarbonate resins, polyphenylene oxide resins, polyamide resins, fluorine resins, cellulose resins, acrylic resins or the like, and thermo-setting or photo-curing resins such as epoxy resins, polyester resins, alkyd resins, phenol resins, melamine resins, polyurethane resins, urea resins, silicone resins, polyimide resins, or the like. Among them, silicone resin, fluorine resin or the like having a parting property, and polyether sulfone resin, polycarbonate resin, polyphenylene oxide resin, polyamide resin, phenol resin, polyester resin, polyurethane resin, styrene resin or the like having high mechanical strength, are desirable.

The one component developer (toner) usable with the present invention will be described.

As for the binder resins, known resins are usable. Examples of such include styrene resins and derivatives such as styrene, α-methylstyrene, p-chlorostyrene; monocarbonic acid and derivatives having a double bond such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitrile, methacrylonitrile, diethylaminoethyl methacrylate, diethylaminoethyl, acryloamide; dicarbonic acid and derivatives having a double bond such as maleic acid, butyl maleate, methyl maleate, dimethyl maleate; a polymer or copolymer of one or more of vinyl monomers such as vinyl resins such as vinyl chloride, vinyl acetate, vinyl benzoate, vinylester resin; vinylether resins, such as vinyl ethyl ether, vinyl methyl ether, vinyl isobutyl ether or the like; styrene-butadiene copolymer, silicone resin, polyester resin, polyurethane resin, polyamide resin, epoxy resin, polyvinyl butyral resin, rosin, modified rosin, terpene resin, phenol resin, aliphatic or alicyclic hydrocarbon resin, aromatic petroleum resin, fluorinated paraffin or the like. They may be used individually or may be used in combination.

The toner may contain pigment, which includes carbon black, nigrosin dye, lamp black, Sudan black SM, fast yellow G, benzidine yellow, pigment yellow, Indofast orange, irgazine red, baranitroanyline red, roluidine resin, carmine FB, permanent bordeaux FRR, pigment orange R, lithol red 2G, lake red C, rhodamine FB, rhodamine B lake, methyl violet B lake, phthalocyanine blue, pigment blue, brilliant green B, phthalocyanine green, oil yellow GG, zapon fast yellow CGG, Kayaset Y 963, Kayaset YG, Sumiplast Yellow GG, Zapon Fast Orange RR, Oil Scarlet, Sumiplast Orange G, Orazole Brown B, Zapon Fast Scarlet CG, Izenspiron Red BEH, Oil Pink OP or the like.

In order for the toner to be given a magnetic property, magnetic particles are contained in the toner. Examples of the magnetic particles include ferromagnetic metal powder such as iron, cobalt, nickel or the like powder and metal alloys or compounds such as magnetite, hematite, ferrite or the like. The content of the magnetic particles is approximately 15–70% by weight on the basis of toner weight.

The toner powder may contain various parting materials. The usable parting materials include polyethylene fluoride, fluorine resin, fluorine carbonized oil, silicone oil, low molecular weight polyethylene, low molecular weight polypropylene and the like. In order to promote the positive or negative charging of the toner, a charge controlling agent may be added. These materials, including the toner binder resin materials, are mixed, kneaded and pulverized through various processes, and the particles having the desirable particle sizes are used as the toner. To the thus obtained toner powder, colloidal silica or the like is added and stirred. Then, it is usable as the toner.

Since the sleeve 2 is coated with the resin layer 10 containing the fine graphite particles in the dispersed state, a part of the electric charge of the fine toner particles overcharged escapes through the graphite particles. In addition, the lubricating nature of the graphite fine particles exposed to the surface of the layer 10 is effective to reduce the deposition force between the fine toner particles and the surface of the sleeve. Therefore, the production of the ghost can be prevented.

Where the fine amorphous carbon particles are dispersed in the layer 10, they contribute to permit a part of the electric charge of the fine particle toner overcharged to escape.

As stated above, the toner is triboelectrically charged more in the end regions than in the middle in the longitudinal direction. Therefore, in the following embodiments, in order to increase the triboelectric toner charging capacity in the middle region of the sleeve relative to the end regions, the content ratio of the electrically conductive particles in the coating layer 10 is varied between the middle regions and the end region of the sleeve 2, or the polishing process of the coating layer 10 is varied between the middle region and the end regions of the sleeve 2.

In this manner, the triboelectric toner charging capacity is made smaller in the end regions of the sleeve than in the middle of sleeve, whereby it becomes possible to give the toner on the sleeve a virtually uniform triboelectric charge in the longitudinal direction of the sleeve.

On the other hand, there is another problem that the development image involves a low image density portion extending in a direction in which the development action proceeds. In the case of character images, the characters are thinned, and in the case of a halftone image or solid black image, the image density is low.

This is called in this Specification "fading". Observing the sleeve when the fading phenomenon occurs has revealed that the toner layer is formed in a uniform thickness on the sleeve. However, measurement of the triboelectric charge amount of the toner on the sleeve has revealed that the charge amount of the toner in the low density region in the image is lower than the normal level.

The reason for the occurrence of the local low charge amount portion is not clear, but it is thought that the fluidity of the toner is locally insufficient in the toner stagnating region in the developing container adjacent to the sleeve.

In any event, the low charge toner particles pass by the friction with the sleeve through a developer layer thickness regulating zone in a thickness equivalent to the normally charged toner particle layer. Therefore, the thickness of the toner layer is uniform on the sleeve.

The fading phenomena tends to occur under high temperature and high humidity conditions in which the triboelectric charge of the toner tends to be low.

According to the preferable aspect of the present invention, the inclination ($\gamma$) of the work function measurement curve of the coating surface layer is not less than 10 (cps/eV). The inclination $\gamma$ corresponds to the quantum efficiency, and therefore, to the triboelectric charge application power to the developer. If the inclination $\gamma$ is not less than 10 (cps/eV), the developer can be provided with sufficient triboelectric charge.

On the other hand, the inclination $\gamma$ also corresponds to the exposure ratio of the graphite fine particles in the coating layer, and therefore, to the degree of the solid lubricance of the coating layer surface. If the inclination $\gamma$ is not less than 10 (cps/eV), the developer particles can fairly easily slide on the surface of the developer carrying member. Therefore, developer having a low electric charge is unable to pass under the developer layer regulation member. Therefore, developer properly charged through triboelectricity is electrostatically deposited on the developer carrying member by the mirror force, so that it can pass under the regulating member.

As a result, a uniform developer layer composed of properly triboelectrically charged developer particles is formed on the developer carrying member, and therefore, fading can be prevented even under high temperature and high humidity conditions.

Furthermore, the image density of the developed image can be stabilized even when a large member of images are continuously printed.

In any case, the surface friction of the development sleeve is reduced, that is, its slipperiness is increased, in the middle region of the sleeve in its longitudinal direction, whereby the friction on the sleeve surface becomes insufficient for the weakly charged toner, in other words, the toner with poor adhesive force to the sleeve, so as to pass the concentrated magnetic field (magnetic curtain) between the blade 6 and the magnet 3, letting pass only the normally charged toner with the proper amount of electrostatic adhesive force to the sleeve.

Incidentally, in the specification of the present invention, the work function defining inclination $\gamma$ is defined as the minimum energy required for taking one electron out of the surface of a material to a position immediately outside the surface. The work function may be measured by a photoelectron measurement device, for example, an AC-1 device available from Riken Keiki Kabushiki Kaisha, Japan. The device AC-1 is characterized in that the work function of the surface of the developing sleeve 2 is easily determined in the atmosphere. It has been confirmed by the inventor that the work functions measured by the device AC-1 is equivalent to the values determined by the Kelvin method (contact potential method, IBM, J. RES. DEVELOP 22, 1978).

Figure 2:
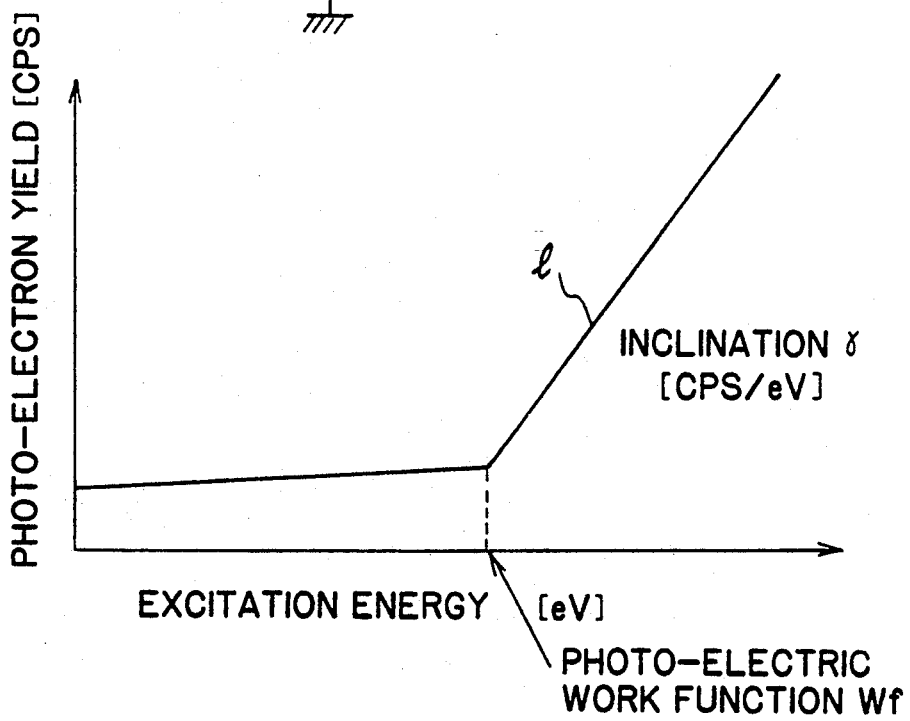
FIG. 2 is a graph representing the work function curve measured at the surface of the development sleeve of the development device in FIG. 1.

FIG. 2 shows the work function measurement curve obtained by the measurement using the device AC-1. In the graph of FIG. 2, the abscissa represents excitation energy (eV), and the ordinate represents the number of photoelectrons (yield) (cps, that is, the count per second). Generally, the number of emitted photoelectrons abruptly increases at a certain level, and therefore, the inclination steeply increases. This point is defined as the level of the work function Wf. The degree of photoelectron emission thereafter (right side of the Wf point) is defined by the inclination $\gamma$ of rectilinear line 1 approximating the measured curve.

Incidentally, a sodium lamp was used as the measurement light source during the measurement, and its luminance intensity was 500 mW.

Below, the embodiments of the present invention will be further explained.

The magnetic toner materials used as the one compound developer in these embodiments are as follows.

The material of the toner used is as follows:

| | |
|---|---|
| Styrene-butylacrylate-n-butylhalfester-maleate copolymer | 100 wt. parts |
| Magnetite | 55 wt. parts |
| Negative charge controlling agent | 3 wt. parts |
| Low-molecular weight polypropylene | 3 wt. parts |

The above mentioned materials were kneaded, pulverized and classified to produce a toner powder having a weight average particle size of 12.2 microns, containing 23% of 6.35 microns or less particles on the basis of number and 1.7% of 20.2 microns or larger toner particles on the basis of weight, and then, used as the magnetic toner.

In order to evaluate the image forming operation, a commercially available laser beam printer LBP-SX (available from Canon Kabushiki Kaisha, Japan) was modified to attach to it an output device capable of providing plural kinds of image patterns. A commercially available process cartridge for the LBP-SX was used as the process cartridge, which supports a photosensitive drum, triboelectric charging device, developing device, and cleaner, integrally within its frame. Flanges were installed at the ends of the following developing sleeves so that they can be mounted in the above mentioned cartridge. The test operations of image formation were carried out under 15° C. and 10% RH and under 32° C. and 85% RH.

In the case of the developing sleeve of Embodiment 1, the composition of the coating layer resin liquid used to form the surface coating resin layer 10 and the mixing formula of its diluting solvent were varied between the middle region and the end regions of the sleeve in the longitudinal direction of the sleeve in order to control the triboelectric toner charging capacity. As for coat forming resin liquids, the following two types of formulas A and B were used.

| | |
|---|---|
| (Coating layer forming resin liquid A) | |
| Phenol resin (binder resin) | 60 wt. parts |
| Graphite | 27 wt. parts |
| Carbon black (amorphous carbon) | 3 wt. parts |
| Isopropanol + butanol (1:1) solvent mixture | 400 wt. parts |
| (coating layer forming resin liquid B) | |
| Phenol resin | 60 wt. parts |
| Graphite | 54 wt. parts |
| Carbon black | 6 wt. parts |
| Methyl ether ketone + toluene (1:1) solvent mixture | 400 wt. parts |

Figure 3:
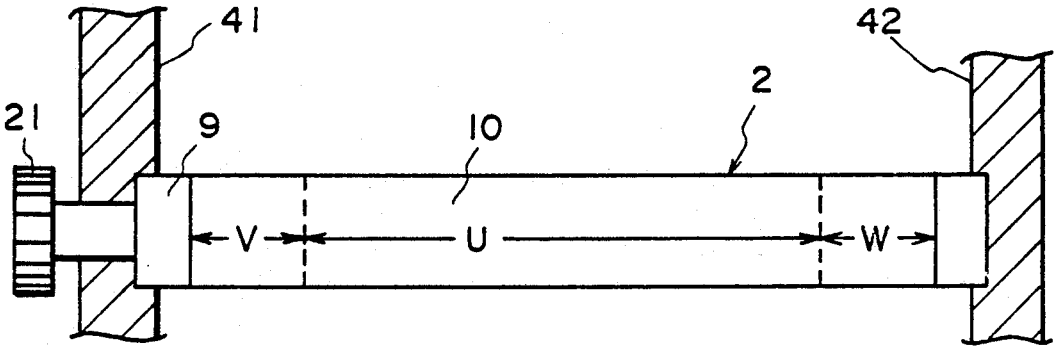
FIG. 3 is an explanatory view showing the surface of the development sleeve coated with coat forming resin liquid in Embodiments 1–6 of the present invention.

The materials for the above mentioned coating layer forming resin liquids A and B were dispersed to satisfy a predetermined condition using a sand mill. These coating layer forming resin liquids A and B were coated on aluminum cylinders (to be mounted on LBP-SX cartridge) using a spray gun. The coating of the sleeve of Embodiment 1 was carried out as shown in FIG. 3.

In other words, the sleeve 2 was masked in the middle region in the longitudinal direction of the sleeve, and then, end regions V and W (approximately 20 mm long in the longitudinal direction of the sleeve) in the longitudinal direction of the sleeve 2 were coated with the spray of resin liquid A. Next, end regions V and W were masked and resin liquid B was sprayed on the middle region U. After both liquids were coated using a spray gun, the cylinders were left in a thermostatic tub at 160° C. for 20 minutes to thermally cure the phenol resin in coat layer forming resin liquids A and B. With the use of the above procedure, coating layer forming resin liquid A was formed into a 10 μm thick resin coating layer 10 covering middle region U in the longitudinal direction of the sleeve, and end regions V and W were coated with coating layer forming resin liquid B to a thickness of 10 μm, thereby producing the developing sleeve of Embodiment 1, in which the graphite content is higher in the middle region U than in end regions V and W.

On the other hand, in the case of the developing sleeve of Comparative Example 1, coating forming resin liquid A was coated on regions, U, V and W, thermally cured for 20 minutes in the same condition of 160° C., and thereby forming a 10 μm thick resin coating layer 10 covering all three regions. As for the developing sleeve of Comparative Example 2, coat forming resin liquid A was coated on regions U, V and W in the same manner and thermally cured in the same manner at 160° C. for 20 minutes, in other words, resin liquid B was used individually to form the entire resin coating layer 10 to a thickness of 10 μm.

These developing sleeves were subjected to the development process as was stated above, whereby images were formed to be evaluated by an image formation test. Also, inclination γ (cps/eV) was measured at middle region U and end regions V and W of the developing sleeve. The obtained results are shown in Table 1.

Table 3, indicates that the image is too inferior to be acceptable.

As shown in Table 1, in the case of Embodiment 1, the inclination γ of the work function measurement curve of the developing sleeve surface is as low as 6.5–7 at both end regions of the sleeve (left V, and right W), in other words, below 10, and is 25 at middle region U, that is, higher than 10. Since the triboelectric tone charging capacity is low at both end regions and higher in a middle region, a toner was not excessively charged up and a image density was high at 1.2–1.4, in the low humidity environment of 15° C. and 10% RH. Also, in the high humidity environment of 32° C. and 85% RH, the images were excellent without any fading, and the image density was high at 1.1–1.3. Excellent results were obtained in all categories.

In contrast to this, in Comparative Example 2, since the inclination γ of the work function measurement curve of the developing sleeve was rendered low at 7.0–7.5 at both the middle region and the end regions, the fading column shows slightly inferior results, and low values of 0.8–1.1 appeared in the image density category. In Comparative Example 2, since the inclination γ of the work function measurement curve of the developing sleeve was rendered high at 23–26, in other words, higher than 10, at both the middle region and the end regions of the sleeve, the charge-up category was slightly inferior and the image density took the values of 0.8–1.3, which was rather low, in the low humidity environment of 15° C. and 10%RH.

Based on the above observations, it becomes evident that in order to produce uniform picture images through a development procedure, that is, in order to prevent the occurrence of fading, in particularly, fading in a high temperature-high humidity environment, and the occurrence of the sleeve ghost, in particular, the sleeve ghost which is caused by the excessively charged toner in the low humidity environment, it is only necessary that the triboelectric toner charging capacity of the developing sleeve be reduced at both sleeve ends (the work function measurement curve of the developing sleeve surface is made smaller than 10, preferably less than 11, in terms of the inclination γ) and is increased in the middle of the sleeve (more than 10, preferably larger than 20, in terms of the above mentioned inclination γ).

TABLE 1

| | γ (cps/eV) | | | 15° C., 10% RH | | 32° C., 85% RH | |
|---|---|---|---|---|---|---|---|
| | Left V | Middle U | Right W | Charge up | Image density | Fading | Image density |
| Embodiment 1 | 7.0 | 25 | 6.5 | ◎ | 1.2–1.4 | ◎ | 1.1–1.3 |
| Comparative Example 1 | 7.5 | 7.5 | 7.0 | ◎ | 1.2–1.4 | Δ | 0.8–1.1 |
| Comparative Example 2 | 23 | 25 | 26 | Δ | 0.8–1.3 | ◎ | 1.1–1.3 |

In Table 1, the image density column indicates the image density dispersion when a large number of copies were continuously made, in other words, the values of solid black section (5 mm square) were measured by a MacBeth reflection densitometer. As for the evaluation of charge-up and fading, ◎ indicates excellent, ○ good, and Δ indicates fair in practical usage level. Incidentally, these symbols are going to be used in the same manner in the following Tables 2–4. Also, the □ symbol, which appears for the first time in Table 2, indicates that the image develops but its density is too low for practical usage, and the X symbol, which appears first time in Incidentally, in FIGS. 3, 41 and 42 are the left and right side walls of container 4 containing the toner 5, and the sleeve 2 is rotatively supported by these side walls 41 and 42. The sleeve 2 is rotated by the driving force transmitted through gear 21 which is attached to the sleeve 2.

In addition to the above mentioned coat forming resin liquid A, coat forming resin liquids C, D, E and F, which employ the formulas shown below, were prepared. These coat forming resin liquids, A, C–F were coated, as needed, on middle region U and both end sections V and W of the sleeve 2 in FIG. 3, in the various patterns and combinations shown in Table 2, whereby the developing sleeves on which resin coating layers 10 containing graphite were formed as Embodiments 2–6. However, end regions V and W were made to be 15 mm long, respectively. Then, images were formed in the same manner as Embodiment 1 and subjected to the same evaluation test.

| | |
|---|---|
| (coating layer resin liquid C) | |
| Phenol resin | 60 wt. parts |
| Graphite | 56 wt. parts |
| Carbon black | 4 wt. parts |
| Methyl alcohol + methylcellusolve | 200 wt. parts |
| (coating layer resin liquid D) | |
| Phenol resin | 60 wt. parts |
| Graphite | 84 wt. parts |
| Carbon black | 6 wt. parts |
| Methyl alcohol + methylcellusolve | 250 wt. parts |
| (coating layer resin liquid E) | |
| Phenol resin | 60 wt. parts |
| Graphite | 23 wt. parts |
| Carbon black | 2 wt. parts |
| Methyl alcohol + methylcellusolve | 200 wt. parts |
| (coating layer resin liquid F) | |
| Phenol resin | 60 wt. parts |
| Graphite | 54 wt. parts |
| Carbon black | 6 wt. parts |
| Isopropanol + methylcellusolve | 200 wt. parts |

The results of image formation evaluation tests and the measured results of the inclination $\gamma$ of the work function measurement curves are shown in Table 2. The meanings of the symbols in Table 2 are the same as were stated before.

TABLE 2

| | Coating layer forming resin liquid | | $\gamma$ (cps/eV) | | | 15° C., 10% RH | | 32° C., 85% R | |
|---|---|---|---|---|---|---|---|---|---|
| | U region | V, W region | Left V | Middle U | Right W | Charge up | Image density | Fading | Image density |
| Embodiment | | | | | | | | | |
| 2 | C | E | 8.5 | 23 | 8.0 | ◎ | 1.3–1.4 | ◎ | 1.1–1.4 |
| 3 | C | A | 7.0 | 24 | 7.5 | ◎ | 1.2–1.4 | ◎ | 1.2–1.4 |
| 4 | C | F | 10 | 25 | 10.5 | ◎ | 1.2–1.4 | ◎ | 1.1–1.3 |
| 5 | D | E | 8.5 | 29 | 7.5 | ◎ | 1.3–1.4 | ◎ | 1.1–1.3 |
| 6 | D | A | 6.5 | 31 | 7.0 | ◎ | 1.2–1.4 | ◎ | 1.2–1.3 |
| Comparative Example | | | | | | | | | |
| 3 | C | C | 25 | 26 | 23 | Δ | 0.7–1.1 | ◎ | 1.2–1.4 |
| 4 | A | C | 26 | 7.0 | 26 | Δ | 0.8–1.4 | Δ | 0.7–1.2 |
| 5 | E | E | 8.0 | 8.0 | 8.0 | □ | 0.7–1.0 | ○ | 1.1–1.4 |

As is shown in Table 2, in the case of Embodiments 2–6, the inclination $\gamma$ of the work function measurement curve of the developing sleeve surface was made to be lower at both sleeve end regions (left V and right W) at 6.5–10.5 (the graphite content ratio is small), and higher at the middle region U at 23–31 (the graphite content ratio is large), in other words, the triboelectric toner charging capacity was caused to be low at both end regions and high in the middle region, and therefore, excellent results were obtained, as was in the case of Embodiment 1, both in the categories of excessive toner charge and image density in the low humidity environment of 15° C. and 10% RH, and in the categories of image fading and image density in the high humidity environment of 32° C. and 85% RH.

In contrast to this, in Comparison Examples 3–5, the inclination $\gamma$ of the work function measurement curve of the developing sleeve surface was sometimes high at more than 10 or conversely, lower than 10, and so on, both in the middle and the end regions of the sleeve, and therefore, slightly inferior results were obtained in at least one of the categories of toner charge-up and image density in the low humidity environment of 15° C. and 10% RH, or fading and image density in the high humidity environment of 32° C. and 85%.

In addition, in the case of the developing sleeves in the above mentioned Embodiments 1–6, it was feared that the respective border line, between the end regions V and W and the middle region U of the resin coating layer surface might affect the developed image, but even precise observations of the images did not reveal the appearance of such effects in the image.

In the above Embodiments, the composition of the resin coating layer 10 on the surface of the developing sleeve 2 was varied between the sleeve end regions and the middle in order to set the triboelectric tone charging capacity to be low at the sleeve end regions and high in the middle, but it is also possible to arrange the same triboelectric tone charging capacity as the above by performing a polishing process on the surface of the developing sleeve 2 after the formation of the resin coating layer 10. In this case, all that is needed is to coat the identical resin liquid on the above mentioned regions U, V and W. In any case, since the adjustment of the amount of graphite exposed at the coating layer surface is possible by adjusting the degree of polishing on the coating layer, the triboelectric toner charging capacity can be adjusted by controlling the sliding property of the surface.

As for the above mentioned polishing process, the resin layer impregnated with fine graphite particles is preferably polished using polishing materials such as felt, woven fabric or paper, which do not contain abrasive particles, after the above liquids are coated on the sleeve member and dried.

Below, an example of the polishing process is shown.

The polishing material used for the polishing is HW felt available from Hayashi Felt Kabushiki Kaisha, Japan, which is 100% wool having a standard density of 0.34 g/cm$^2$. It has a width of 40 mm, a length of 200 mm and a thickness of 3 mm.

Figure 4:
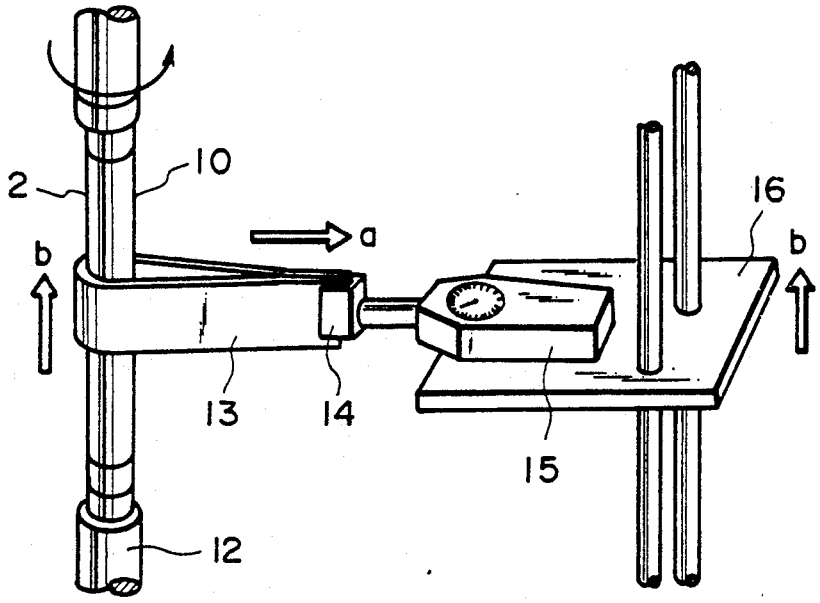
FIG. 4 is a perspective view of the polishing device, in accordance with the present invention, which is used to polish the development sleeve surface.

FIG. 4 shows a surface polishing apparatus capable of easily exposing the crystalline graphite contained in the coating layer 10 of the developing sleeve 2. As shown in this figure, the developing sleeve 2 is placed vertically, and is fixed by main shaft 12 at the top and bottom ends, and is rotated by main shaft 12, which is driven by a driving device (not shown). Around the developing sleeve 2, a polishing felt 13 in the form of a strand fixed on a holder 14 is extended, and is pulled in direction a. The tension load at this time is measured by a load detector 15 directly connected to the holder 14. The load detector 15 is mounted on a carriage 16b movable together with the felt 13 in the longitudinal direction of the developing sleeve 2.

The developing sleeve fixed to a shaft 12 at the longitudinal ends thereof is rotated at a predetermined speed. At the initial stage, the felt should not be allowed to contact the freshly formed resin coating layer 10 of the developing sleeve 2, and therefore, the felt 13 is placed either at the top or bottom end of the developing sleeve 2. Felt 13 is pulled with a predetermined load using the load detector 15 through the holder 14 affixed to the felt 13, and a carriage 16 is moved up or down relative to the developing sleeve 2 at a predetermined speed. By doing so, the surface of the developing sleeve 2 is polished by the felt 13 press-contacted thereto, by which the crystalline graphite contained in the coating layer 10 is exposed.

Figure 5:
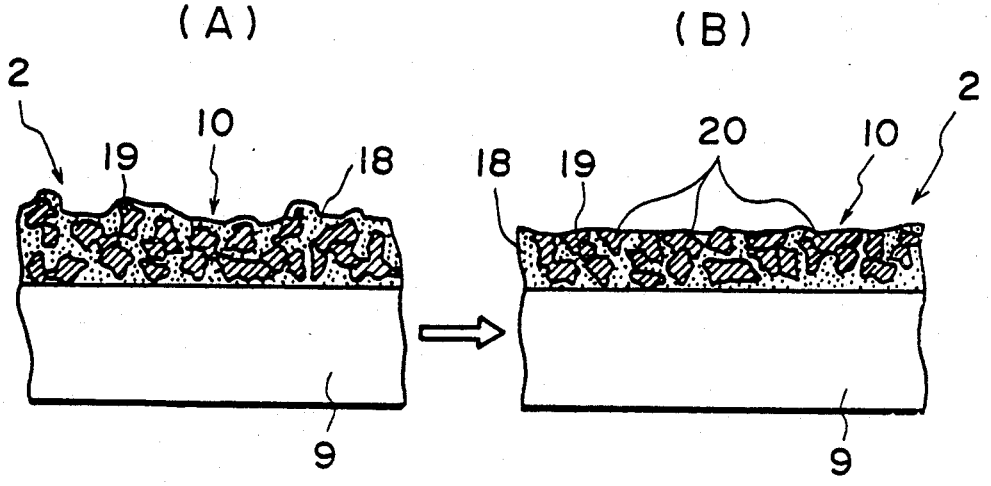
FIG. 5 is a sectional view of the development sleeve surface conditions before and after the polishing process using the device in FIG. 4.

FIG. 5A is a sectional view of the developing sleeve 2 surface before the polishing process, and FIG. 5B shows the same after the polishing process. When the felt 13 is press-contacted to the resin coating layer 10 surface comprising the binder resin 18 and the crystalline graphite 19 shown in FIG. 5A, the surface portion of the coating layer 10 is collapsed by the pressure, and a shearing force is applied with the result of shear fracture thereof. Then, as shown in FIG. 5A, the crystalline of a graphite 19 coated with thin film of the binder resin 18 in the coating layer 10 is exposed, and therefore, the surface of crystals 20 appears. By controlling the pressure applied by the felt 13, the degree of graphite 19 exposure can be controlled. By selecting the width of the felt 13, the degree of exposure of graphite 19 can be controlled. Binder resin 18 or crystalline graphite 19 (and also the conductive amorphous carbon or the like if any) in the coating layer 10 are gradually absorbed by the felt when they are removed from the coating layer 10, because the surface of the felt 13 is soft. The removed materials do not remain on the surface of the developing sleeve 2, and therefore, the surface of the developing sleeve 2 is polished while being cleaned.

Here, the degree of graphite exposure, that is, the above mentioned inclination $\gamma$, can be controlled by controlling the extent of polishing given to the coating layer. The above mentioned amount of polishing can be controlled by adjusting any one, or combinations of any two or three, among the factors such as the pressure applied on the coating layer by the polishing member (felt), relative speed between the coating layer and the polishing member, and duration of the polishing process. The greater the amount of polishing, (for example, the higher the above mentioned contact pressure, and/or the higher the relative speed), the larger the degree of graphite exposure becomes, thereby increasing the above mentioned inclination $\gamma$.

Figure 6:
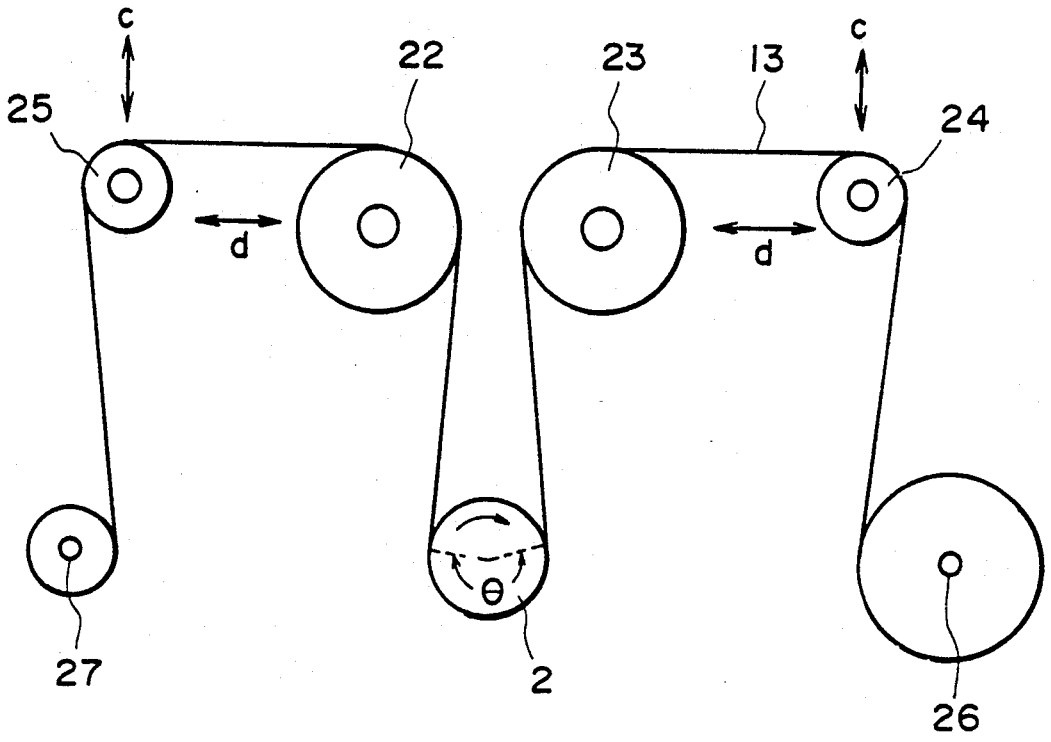
FIG. 6 is a plan view showing schematically the polishing device to be used in Embodiments 7–18 of the present invention.

The polishing device in FIG. 6 is provided with a feeding shaft 26 and a take-up shaft 27 for the felt web 13, and the felt 13 is fitted on a sleeve 22, pulleys 22, 23, 24 and 25, as is shown in the figure. The contact pressure applied on the sleeve 2 by the felt 13 can be adjusted by displacing the pulleys 24 and 25 in the direction of arrow c, and take-up angle $\theta$ can be adjusted by displacing pulleys 22 and 23 in the direction of arrow d. Members 22–27 are mounted on the same sinkable table, which can be moved up and down perpendicularly to this page, that is, in the longitudinal direction of the sleeve 2, whereby the sleeve can be polished by the felt which slides up and down in the same longitudinal direction, while the sleeve 2 is driven to rotate. It is also acceptable to move the sleeve 2 itself in its longitudinal direction, instead of the above mentioned table.

In any case, the above mentioned amount of polishing can be varied while the above mentioned table or the sleeve is being moved, whereby the coating layer is polished so that the triboelectric charge capacity is caused to be larger in the middle in the longitudinal direction of the sleeve than at the end regions.

Below, Embodiments of polished sleeve are explained in detail.

Incidentally, the magnetic toners employed in the following embodiments are shown in next table.

| | |
|---|---|
| Styrene-butyacrylate-acrylic acid copolymer | 100 wt. parts |
| Magnetite | 50 wt. parts |
| Negative charge controlling agent | 2 wt. parts |
| Low-molecular weight polypropylene | 4 wt. parts |

The materials are mixed, kneaded, pulverized and classified into toner powder having a weight average particle size of 11.3 microns, and containing 28% of 6.35 microns or less particles on the basis of the number and containing 0.7% of 20.2 microns or larger particles on the basis of light (measured by Coulter Counter TA-II). To the toner powder, colloidal silica of 0.6% was added. This was used as the magnetic toner.

The developing sleeve 2 in accordance with the present invention was produced in the following manner. The materials mixed in the coating layer resin liquid were as follows:

| | |
|---|---|
| Phenol resin: | 30 parts by weight |
| Crstalline graphite (average particle size of 8 micron): | 41 parts by weight |
| Carbon black | 4 parts by weight |

The above materials were dispersed in 250 weight parts of the mixed liquid of isopropyl alcohol/butyl alcohol (1:1), using a sand mill, to prepare the coating layer resin liquids. This was coated on the aluminum cylinder (flanges were attached in advance at the opposite ends), using a spray gun, and then, the liquid was cured under the temperature of 150° C. into a resin coating layer having a thickness of 9 microns.

Next, the surface of the developing sleeve 2 was polished using the polishing device shown in FIG. 6 while the tension pressure of the felt 1, that is the polishing member, polishing duration (moving speed of the felt in the longitudinal direction of the developing sleeve 2), and contact angle of the felt to the developing sleeve were being adjusted.

The content angle $\theta$ of the felt 13 to the developing sleeve 2 was made to be small at both end regions of the developing sleeve 2 and large in the middle region. Also, the moving speed of the felt 13 in the perpendicular direction to the page of FIG. 6 (longitudinal direction of the developing sleeve 2) was caused to be faster at both end regions and slow in the middle.

Figure 7:
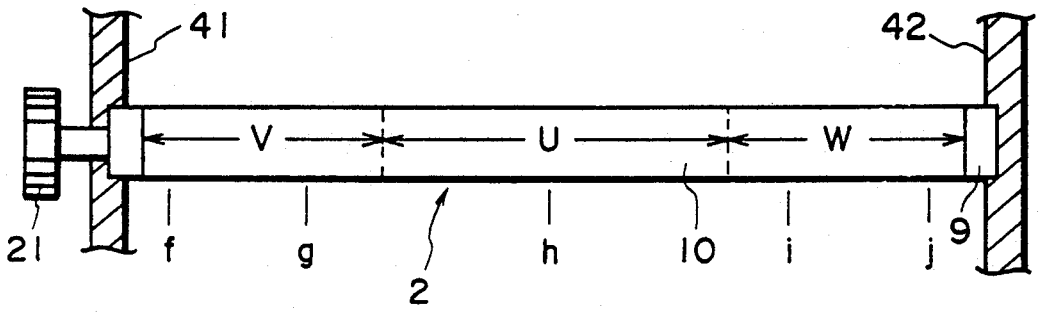
FIG. 7 is an explanatory view of the development sleeve surfaces after the polishing processes in Embodiments 7–12 of the present invention.

FIG. 7 is a schematic diagram to explain the produced developing sleeve. When the developing sleeve is polished right to left starting from the right end region W, across middle region U, and to the left end region V in the figure, right end region W is the region where the contact angle of the felt 13 to the sleeve changes from a small one to a large one and the shifting speed of the felt 13 changes from a large one to a small one, whereas the left end region V is the region where the contact angle of the felt 13 to the sleeve and the shifting speed change in reverse. The middle region U is the region where the contact angle is largest and remains constant and the shifting speed also remains constant.

Points f, g, h, i and j indicated by the arrows in FIG. 7 are the points for visual examination. In this embodiment, visual examination point f shows a position within less than 5 mm from the left end of the resin coat layer formation region in FIG. 7, g within 20 mm from the same place, h approximately the middle, and i and j show the positions symmetrical to g and f, respectively. The width of the regions where the triboelectric toner charge was measured were 30 mm at both end regions V and W of the developing sleeve and 30 mm in the middle region U, with h as its center.

As the surface conditions of the developing sleeve were visually examined at these points using an FE-SEM (Field Emission-Scanning Electron Microscope) or the like, it was clearly shown that point h gave a more polished appearance compared to points j and f, which coincided with the condition of the exposure of the graphite impregnated in the resin coating layer. Points g and i showed a condition in between two. The inclination $\gamma$ (cps/eV) of the work function measurement curve of the developing sleeve surface was obtained by measuring it at these visual examination points.

The above mentioned developing sleeves were mounted in the cartridge for the LBP-SX to be subjected to the developing process, whereby the image formation test was performed. At the same time, the amount of the triboelectric toner charge on the developing sleeve was also measured. The results are shown in Table 3 along with the results for the comparative examples.

the level for practical usage, and X indicates unacceptable.

As is shown in Table 3, in Embodiments 7–12, since the developing sleeve surfaces were subjected to the polishing process to cause the triboelectric toner charge capacity to be low at both sleeve end regions and high in the middle region, excellent results were obtained in all categories of the image density, toner charge-up, and amount of triboelectric toner charge after the continuous production of 100 copies in the environment of 15° C. and 10% RH, and in toner charge, along with image density and image fading, in the environment of 32° C. and 85% RH.

Embodiments 13–18

The developing sleeve 2 was produced by the method explained below. The materials formulated in the coating forming resin liquid are as follows:

| | |
|---|---|
| Phenol resin | 30 wt. parts |
| Crystalline graphite | 22.5 wt. parts |
| Carbon black | 2.5 wt. parts |

The above materials were formed into an approximately 8 mm thick resin coating layer 10 on the developing sleeve surface in the same manner as in the case of Embodiments 7–12, except that 200 parts by weight of the mixture of methyl alcohol/methylcellusolve (1:1) were employed.

Figure 8:
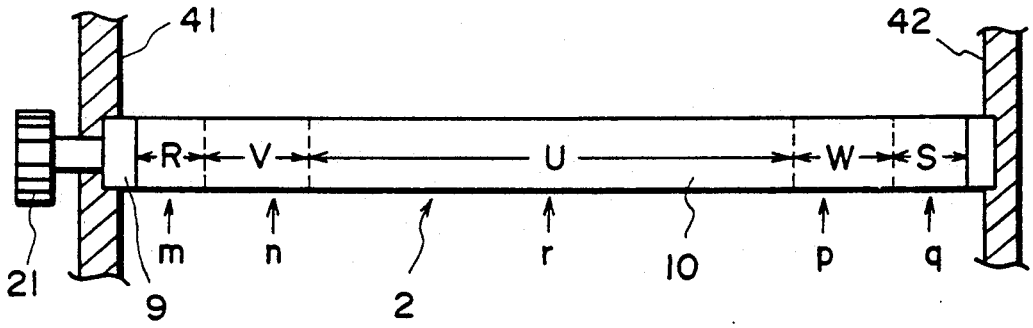
FIG. 8 is an explanatory view of the development sleeve surfaces after the polishing process in Embodiments 13–18 of the present invention.

Next, as is shown in FIG. 8, both sleeve end regions R and S were left unpolished but the inward regions V (left), U (middle) and W (right) were subjected to the same polishing process as that of Embodiments 7–12. In FIG. 8, the width of far left end section R and far right end section S were made to be 20 mm, respectively.

TABLE 3

| | γ (cps/eV) | | | | | 15° C., 10% | | Amount of toner charge (μC/g) | | | 32° C., 85% | | |
|---|---|---|---|---|---|---|---|---|---|---|---|---|---|
| | f | g | h | i | j | Charge up | Image density | U | V | E | Fading | Image density | Note |
| Embodiment | | | | | | | | | | | | | |
| 7 | 8.5 | 12.5 | 35 | 14.5 | 8.5 | ◎ | 1.3–1.4 | 7.2 | 8.0 | 6.6 | ◎ | 1.1–1.3 | |
| 8 | 8.5 | 17 | 36 | 19 | 8.0 | ◎ | 1.2–1.4 | 7.2 | 7.4 | 7.0 | ◎ | 1.1–1.3 | |
| 9 | 8.0 | 16 | 25 | 19 | 7.5 | ◎ | 1.3–1.4 | 7.2 | 7.0 | 7.0 | ○ | 1.0–1.3 | |
| 10 | 7.0 | 14 | 40 | 18 | 7.5 | ○ | 1.1–1.4 | 8.4 | 8.8 | 7.4 | ◎ | 1.1–1.4 | |
| 11 | 9.0 | 24 | 35 | 22 | 8.5 | ○ | 1.1–1.4 | 8.5 | 8.8 | 8.8 | ◎ | 1.1–1.3 | |
| 12 | 7.5 | 23 | 30 | 20 | 7.0 | ◎ | 1.2–1.4 | 7.7 | 7.3 | 6.9 | ◎ | 1.1–1.3 | |
| Comparative Example | | | | | | | | | | | | | |
| 6 | 4.5 | 5.0 | 5.0 | 5.5 | 3.5 | ◎ | 1.2–1.3 | 4.6 | 3.5 | 4.2 | X | 0.8–1.2 | *1 |
| 7 | 34 | 33 | 35 | 37 | 30 | □ | 0.7–1.3 | 0.3 | 9.5 | 11.3 | ◎ | 1.1–1.4 | *2 |
| 8 | 20 | 24 | 24 | 23 | 24 | Δ | 0.9–1.4 | 1.0 | 11.3 | 11.0 | ◎ | 1.1–1.3 | *3 |
| 9 | 35 | 8.5 | 7.5 | 9.0 | 30 | □ | 0.7–1.2 | 0.3 | 4.2 | 11.5 | X | 0.7–1.2 | *4 |

*1: No polishing over entire surface
*2: Strong polishing over entire surface
*3: Strong polishing over entire surface
*4: Strong polishing in both end regions In Table 3, the image density column shows the image density dispersion over the entire picture surface during the continuous production of 500 copies, and was measured by a MacBeth reflection densitometer. The column for the amount of the triboelectric toner charge shows the amount of the triboelectric toner charge measured by vacuuming the toner remaining coated on the developing sleeve after the production of 100 copies. The evaluation symbols show, as was explained before, ◎ indicates excellent, ○ good, Δ fair but not problematic in practical usage, □ fair but below Point m for the visual examination of the developing sleeve surface shows a location within 5 mm from the left end of the resin coating layer formation region, n is within 20 mm from the same place, r is approximately at the middle of the above mentioned region U, and p and q show locations symmetrical to n and m, respectively. The measurement of the triboelectric toner charge and the image evaluation were performed in the same manner as was stated before. The results obtained are shown in Table 4, along with the results of comparative examples.

TABLE 4

| | γ (cps/eV) | | | | | 15° C., 10% | | | | | 32° C., 85% | |
|---|---|---|---|---|---|---|---|---|---|---|---|---|
| | | | | | | Charge | Image | Amount of toner charge (μC/g) | | | | |
| | m | n | r | p | q | up | density | R, V | U | W, S | Fading | Image density |
| Embodiment | | | | | | | | | | | | |
| 13 | 4.0 | 13 | 34 | 12.0 | 3.5 | ◎ | 1.3–1.4 | 7.2 | 7.9 | 6.9 | ○ | 1.0–1.3 |
| 14 | 3.5 | 17 | 33 | 16 | 3.0 | ◎ | 1.2–1.4 | 7.5 | 8.3 | 6.8 | ◎ | 1.1–1.3 |
| 15 | 3.5 | 20 | 25 | 20 | 3.5 | ◎ | 1.2–1.4 | 8.1 | 7.3 | 8.2 | ◎ | 1.1–1.3 |
| 16 | 4.5 | 12 | 27 | 14 | 3.5 | ◎ | 1.3–1.4 | 7.8 | 7.4 | 7.2 | ○ | 1.0–1.2 |
| 17 | 4.0 | 24 | 35 | 18 | 4.5 | ○ | 1.1–1.4 | 8.5 | 8.5 | 8.3 | ◎ | 1.1–1.3 |
| 18 | 4.5 | 17 | 40 | 19 | 4.0 | ○ | 1.1–1.3 | 8.6 | 8.7 | 8.8 | ◎ | 1.1–1.4 |

As is shown in Table 4, in Embodiments 13–18, since the developing sleeve surface was polished to cause the triboelectric toner charging capacity to be low at both sleeve end sections and high in the middle, excellent results were obtained in all categories of image density, toner charge-up, and amount of triboelectric toner charge on the developing sleeve after the continuous production of 100 copies in the environment of 15° C. and 10% RH, along with image density and image fading in the environment of 32° C. and 85% RH.

Though it is not recorded in Table 4, the images obtained in Embodiments 13–18 exhibited no abnormalities, such as abnormal density variation at the border line with the polished region, in the picture area corresponding to the unpolished regions of the developing sleeve.

These results also verify that the inclination γ is preferably more than 10, or more preferably, more than 20, in the middle region of the sleeve, and the inclination γ is preferably less than 10, more preferably less than 11, at both sleeve end regions.

In addition, the above mentioned polishing process may be performed on the coating layer formed of the above mentioned resin liquids A–F or the coating layer formed of the resin liquids G–H described below.

| | |
|---|---|
| (Resin coat forming liquid G) | |
| Phenol resin | 30 wt. parts |
| Natural graphite | 27 wt. parts |
| Carbon black | 3 wt. parts |
| Methyl alcohol + methylcellusolve | 200 wt. parts |
| (Resin coat forming liquid H) | |
| Phenol resin | 15 wt. parts |
| Artificial graphite | 15 wt. parts |
| Methyl alcohol + methylcellusolve | 225 wt. parts |

The above Embodiments were explained using the case in which the magnetic toner was employed as a single component developer, but the present invention is not limited to these embodiments and can be applied to cases in which a single component developer composed of non-magnetic toner is employed.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a movable developer carrying member for carrying a one component developer to a developing zone in which the developer is supplied to an electrostatic latent image bearing member;

a regulating member for regulating a thickness of a layer of the developer to be carried to the developing zone on said developer carrying member;

wherein said developer carrying member comprises a coating layer comprising a resin material in which fine graphite particles are disposed, and wherein this coating layer triboelectrically charges the developer, and the triboelectric charging capacity of this coating layer is larger in a middle region of the developer carrying member than in end regions of the developer carrying member in its longitudinal direction.

2. A developing apparatus according to claim 1, wherein a content ratio of the fine graphite particles is higher in said middle region than said end regions.

3. A developing apparatus according to claim 2, wherein said coating layer is polished and the amount of polishing is greater in said middle region than said end regions.

4. A developing apparatus according to claim 3, wherein fine amorphous carbon particles are dispersed in said coating layer.

5. A developing apparatus according to claim 3, further comprising a power source for applying oscillating bias voltage to the developer carrying member.

6. A developing apparatus according to claim 5, wherein the thickness of the developer layer regulated by said regulating member is thinner than a minimum gap between the developer carrying member and the electrostatic latent image bearing member, in the developing zone.

7. A developing apparatus according to claim 5, wherein said regulating member faces the developer carrying member, with a gap between them.

8. A developing apparatus according to claim 5, further comprising a stationary magnet disposed within the developer carrying member, wherein said one component developer is magnetic developer, and said regulating member is also a magnetic component which faces the magnetic poles of said magnet, with the developer carrying member between them, and forms a magnetic field between the developer carrying member and the regulating member.

9. A developing apparatus according to claim 2, wherein an inclination of the work function measurement of said coating layer surface is more than 10 (cps/eV) in said middle region, and less than 10 (cps/eV) in said end regions.

10. A developing apparatus according to claim 9, wherein fine amorphous carbon particles are dispersed in said coating layer.

11. A developing apparatus according to claim 9, further comprising a power source for applying oscillating bias voltage to the developer carrying member.

12. A developing apparatus according to claim 11, wherein the thickness of the developer layer regulated by said regulating member is thinner than a minimum gap between the developer carrying member and the electrostatic latent image bearing member, in the developing zone.

13. A developing apparatus according to claim 11, wherein said regulating member faces the developer carrying member, with a gap between them.

14. A developing apparatus according to claim 11, further comprising a stationary magnet disposed within the developer carrying member, wherein said one component developer is magnetic developer, and said regulating member is also a magnetic component which faces the magnetic poles of said magnet, with the developer carrying member between them, and forms a magnetic field between the developer carrying member and the regulating member.

15. A developing apparatus according to claim 2, wherein fine amorphous carbon particles are dispersed in said coating layer.

16. A developing apparatus according to claim 2, further comprising a power source for applying oscillating bias voltage to the developer carrying member.

17. A developing apparatus according to claim 16, wherein the thickness of the developer layer regulated by said regulating member is thinner than a minimum gap between the developer carrying member and the electrostatic latent image bearing member, in the developing zone.

18. A developing apparatus according to claim 16, wherein said regulating member faces the developer carrying member, with a gap between them.

19. A developing apparatus according to claim 16, further comprising a stationary magnet disposed within the developer carrying member, wherein said one component developer is magnetic developer, and said regulating member is also a magnetic component which faces the magnetic poles of said magnet, with the developer carrying member between them, and forms a magnetic field between the developer carrying member and the regulating member.

20. A developing apparatus according to claim 1, wherein said coating layer is polished and the amount of polishing is greater is rendered more in said middle region than said end regions.

21. A developing apparatus according to claim 20, wherein fine amorphous carbon particles are dispersed in said coating layer.

22. A developing apparatus according to claim 20, further comprising a power source for applying oscillating bias voltage to the developer carrying member.

23. A developing apparatus according to claim 22, wherein the thickness of the developer layer regulated by said regulating member is thinner than a minimum gap between the developer carrying member and the electrostatic latent image bearing member, in the developing zone.

24. A developing apparatus according to claim 22, wherein said regulating member faces the developer carrying member, with a gap between them.

25. A developing apparatus according to claim 22, further comprising a stationary magnet disposed within the developer carrying member, wherein said one component developer is magnetic developer, and said regulating member is also a magnetic component which faces the magnetic poles of said magnet, with the developer carrying member between them, and forms a magnetic field between the developer carrying member and the regulating member.

26. A developing apparatus according to claim 1, wherein an inclination of the work function measurement curve of said coating layer surface is more than 10 (cps/eV) in said middle region, and less than 10 (cps/eV) in said end regions.

27. A developing apparatus according to claim 26, wherein fine amorphous carbon particles are dispersed in said coating layer.

28. A developing apparatus according to claim 26, further comprising a power source for applying oscillating bias voltage to the developer carrying member.

29. A developing apparatus according to claim 28, wherein the thickness of the developer layer regulated by said regulating member is thinner than a minimum gap between the developer carrying member and the electrostatic latent image bearing member, in the developing zone.

30. A developing apparatus according to claim 28, wherein said regulating member faces the developer carrying member, with a gap between them.

31. A developing apparatus according to claim 28, further comprising a stationary magnet disposed within the developer carrying member, wherein said one component developer is magnetic developer, and said regulating member is also a magnetic component which faces the magnetic poles of said magnet, with the developer carrying member between them, and forms a magnetic field between the developer carrying member and the regulating member.

32. A developing apparatus according to claim 1, wherein fine amorphous carbon particles are dispersed in said coating layer.

33. A developing apparatus according to claim 1, further comprising a power source for applying oscillating bias voltage to the developer carrying member.

34. A developing apparatus according to claim 33, wherein the thickness of the developer layer regulated by said regulating member is thinner than a minimum gap between the developer carrying member and the electrostatic latent image bearing member, in the developing zone.

35. A developing apparatus according to claim 33, wherein said regulating member faces the developer carrying member, with a gap between them.

36. A developing apparatus according to claim 33, further comprising a stationary magnet disposed within the developer carrying member, wherein said one component developer is magnetic developer, and said regulating member is also a magnetic component which faces the magnetic poles of said magnet, with the developer carrying member between them, and forms a magnetic field between the developer carrying member and the regulating member.

37. A developer carrying member for carrying a one component developer to a developing zone where the developer is supplied to an electrostatic latent image, comprising:

a base member;

an outer coating layer on said base member and comprising a resin material and fine graphite particles dispersed therein, wherein the triboelectric developer charging capacity of this outer coating layer is larger in a middle region of the developer carrying member in its longitudinal direction than in end regions of the developer carrying member in the longitudinal direction.

38. A developer carrying member according to claim 37, wherein the content ratio of the fine graphite particles is higher in said middle region than in the end regions.

39. A developer carrying member according to claim 37, wherein said coating layer is polished, and the amount of polishing is greater in said middle region than in said end regions.

40. A developer carrying member according to claim 37, wherein an inclination of the work function measurement curve of said coating layer surface is more than 10 (cps/eV) in said middle region, and less than 10 (cps/eV) in said end regions.

41. A developing carrying member according to one of claims 37–40, wherein fine amorphous carbon particles are dispersed in said coating layer.

* * * * *

UNITED STATES PATENT AND TRADEMARK OFFICE

CERTIFICATE OF CORRECTION

PATENT NO. : 5,274,426

DATED : December 28, 1993

INVENTOR(S) : YASUHIDE GOSEKI, ET AL.

It is certified that error appears in the above-indentified patent and that said Letters Patent is hereby corrected as shown below:

On the title page,

OTHER PUBLICATIONS at [56]

Under "H.B. Michaelson," the term "tronegatively" should be --tronegativity--; and
"Patent Abstract of Japan," should be --Patent Abstracts of Japan--.

COLUMN 1

Line 18, "particle" should be --particles--.

COLUMN 2

Line 50, "comprising" should be --having--;
Line 57, "articles" should be --particles--;
Line 57, "regions" should be --region-- and "region" should be --regions--.

COLUMN 3

Line 52, "an" should be --a--.

COLUMN 4

Line 27, "the" (first occurrence) should be --the rotation of--; and "sleeve 2 rotation," should be --sleeve ,--; and
Line 65, "blacks," should be --black,--.

COLUMN 6

Line 42, "regions" should be --region-- and "region" should be --regions--; and
Line 48, "of" should be --of the--.

COLUMN 9

Line 68, "appears" should be --appears for the--.

UNITED STATES PATENT AND TRADEMARK OFFICE

CERTIFICATE OF CORRECTION

PATENT NO. : 5,274,426

DATED : December 28, 1993

INVENTOR(S) : Yasuhide Goseki, et al.

It is certified that error appears in the above-indentified patent and that said Letters Patent is hereby corrected as shown below:

COLUMN 10

Line 10, "a" (first occurrence) should be --the--;
Line 11, "a" should be --the--;
Line 34, "particularly," should be --particular,--; and
Line 36, "the" (second and third occurrence) should be --a--.

COLUMN 11

Line 66, "10 or" should be --10, or--.

COLUMN 12

Line 7, "line," should be --lines--; and
Line 66, "direction a." should be --direction "a".--.

COLUMN 13

Line 50, "polishing," should be --polishing--.

COLUMN 14

Line 14, "-butyacrylate-" should be ---butylacrylate---; and
Line 54, "content" should be --contact--.

UNITED STATES PATENT AND TRADEMARK OFFICE

CERTIFICATE OF CORRECTION

PATENT NO. : 5,274,426

DATED : December 28, 1993

INVENTOR(S) : Yasuhide Goseki, et al.

It is certified that error appears in the above-indentified patent and that said Letters Patent is hereby corrected as shown below:

COLUMN 15

Line 24, "between two" should be --between the two--.

COLUMN 19

Line 45, "is rendered more" should be deleted.

COLUMN 22

Line 6, "developing" should be --developer--.

Signed and Sealed this

Fifth Day of July, 1994

Bruce Lehman

*Attest:*

BRUCE LEHMAN

*Attesting Officer*

*Commissioner of Patents and Trademarks*